US006398481B2

(12) United States Patent
Chen

(10) Patent No.: US 6,398,481 B2
(45) **Date of Patent: *Jun. 4, 2002**

(54) PRINTER COLLATORS FOR COLLATING PRINTED PAPERS IN MORE THAN ONE POSITIONS

(75) Inventor: Philip L. Chen, Rolling Hills, CA (US)

(73) Assignee: Avision Inc., Hsinchu (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/078,739

(22) Filed: May 14, 1998

(51) Int. Cl.[7] ..... B65H 33/06
(52) U.S. Cl. ..... 414/791.2; 271/213; 271/207
(58) Field of Search ..... 271/213, 207, 271/3.03, 791.2; 414/791.2; 74/50

(56) References Cited

U.S. PATENT DOCUMENTS

| | | | | | |
|---|---|---|---|---|---|
| 3,058,361 | A | * | 10/1962 | Freeborn | 74/50 |
| 3,451,276 | A | * | 6/1969 | Wadlow et al. | 74/50 |
| 4,188,025 | A | * | 2/1980 | Gusfafson et al. | 271/213 X |
| 4,208,122 | A | * | 6/1980 | Iwamoto et al. | 414/791.2 X |
| 4,382,592 | A | * | 5/1983 | Harding et al. | 270/53 |
| 4,664,507 | A | * | 5/1987 | Fukae et al. | 271/217 X |
| 5,173,785 | A | * | 12/1992 | Muramatsu | 271/213 |

* cited by examiner

*Primary Examiner*—Christopher P. Ellis
*Assistant Examiner*—Patrick Mackey
(74) *Attorney, Agent, or Firm*—Winston Hsu

(57) ABSTRACT

A single tray is used to collate the printed papers from a printer. The tray is moved to different positions to receive the printed papers. Thus, the printed papers are collated into different stacks. The movement of the tray can be linear or curvilinear. The circular movement can collate the printed papers into more than two stacks.

3 Claims, 11 Drawing Sheets

PRINTER COLLATORS FOR COLLATING PRINTED PAPERS IN MORE THAN ONE POSITIONS

BACKGROUND OF THE INVENTION

This invention relates to collators for printers.

Among the peripheral equipment for a computer, a printer is an important one. For the output of the printer, collating is an important function. Conventional collators customarily use a multiple tray structure to sort the printed sheets. Such a design is very complicated and hence very costly.

A conventional multiple tray collator typically has the following operation. If a stack of document has, say, 5 pages, the pages are numbered as #1, #2, #3, #4 and #5. If three copies are to be outputted, the output can have at least the three following modes:

(1) Select in the first tray three copies #1, #1, #1; in the second tray three copies #2, #2, #2; in the third tray three copies #3, #3, #3; in the fourth tray three copies #4, #4, #4; and in the fifth tray three copies #5, #5, #5. Then the copies in each tray are taken out and manually collate them in the order #1, #2, #3, #4, #5 into three stacks.

(2) Select in the first tray five pages #1, #2, #3, #4, #5; in the second tray five pages #1, #2, #3, #4, #5; in the third tray five pages #1, #2, #3, #4, #5.

(3) Select different numbers for different pages. For instance: the first tray has five pages, #1, #2, #3, #4, #5; the second tray has three pages #1, #2, #3; and the third tray has four pages #1, #3, #4, #5, In all the foregoing output traditional methods, a multiple tray collating equipment is used. The structure is very complicated, costly and unreliable.

SUMMARY OF THE INVENTION

An object of this invention is to use a single tray to collate papers for a printer. Another object of this invention is to provide a collator which simplifies the structure, reduces the cost and is more reliable. Still another object of the invention is to miniaturize the collator to be lighter and thinner.

These objects are achieved by using a single tray and moving the tray in different positions to collate the printed papers into different stacks. The movement may be a linear one or a circular one. The printed papers can be collated into multiple numbers of stacks.

DETAILED DESCRIPTION OF THE PREFERRED EMBODIMENTS

Figure 1A:
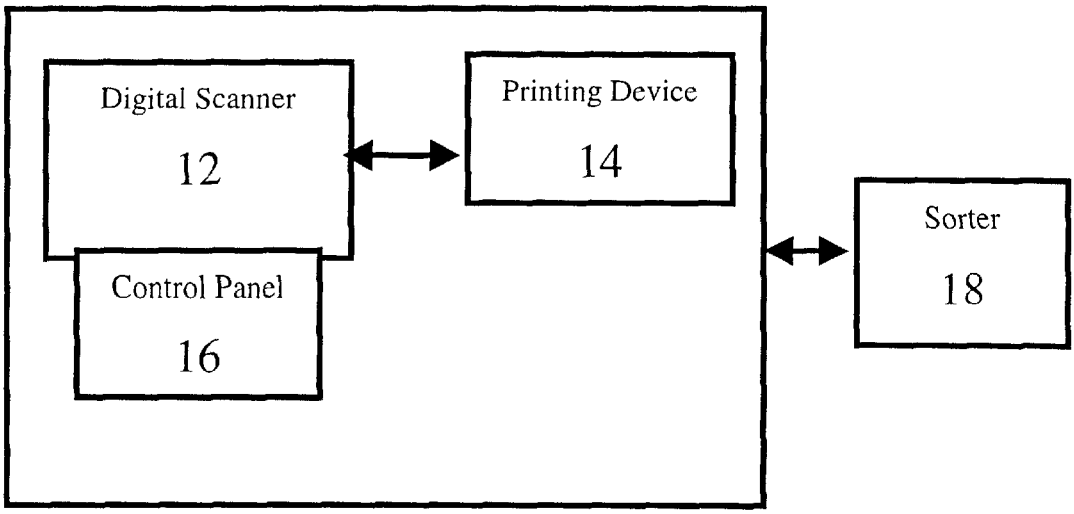
Fig. 1A Prior art.
FIG. 1A shows the block diagram of a conventional collator.

FIG. 1A shows a block diagram of a printer system. A digital scanner 12 sends its data to a printing device 14 to finish a printed output. The printing device has a central processing unit (not shown), which controls the operation of the collator or sorter 18. A control panel allows a user to select the printer requirements.

Figure 1B:
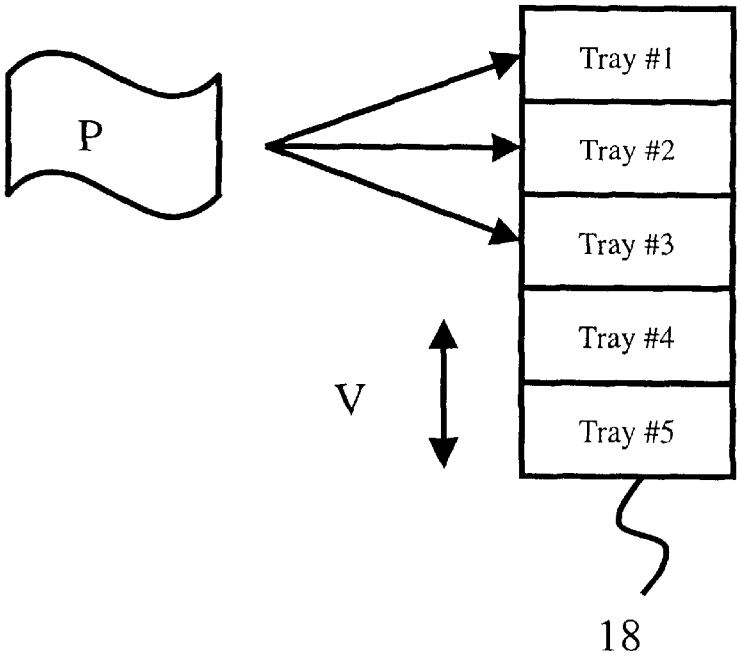
Fig. 1B. Prior art.
FIG. 1B shows the page dispensing scheme of a conventional collator.

FIG. 1B shows the structure of a prior art collator of a printer. After finishing printing, the printed papers P are dispatched to the collator. For the purpose of explanation, the collator shown has five trays: Tray #1, Tray #2, Tray #3, Tray #4 and Tray #5. The collator 18 dispatches the printed papers to the different trays according to the instruction from the central processing unit (CPU, not shown), which controls the vertical motion of the collator 18 to collect the printed papers.

Figure 1C:
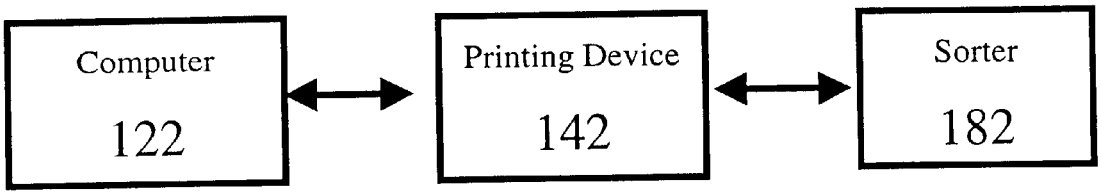
Fig. 1C. Prior art.
FIG. 1C shows the interconnection among a computer, a printer and a sorter.

FIG. 1C shows the connections among the connection between the printing device 142 with the computer 122 and the connection between the printing device 142 with the collator 182.

Figure 2A:
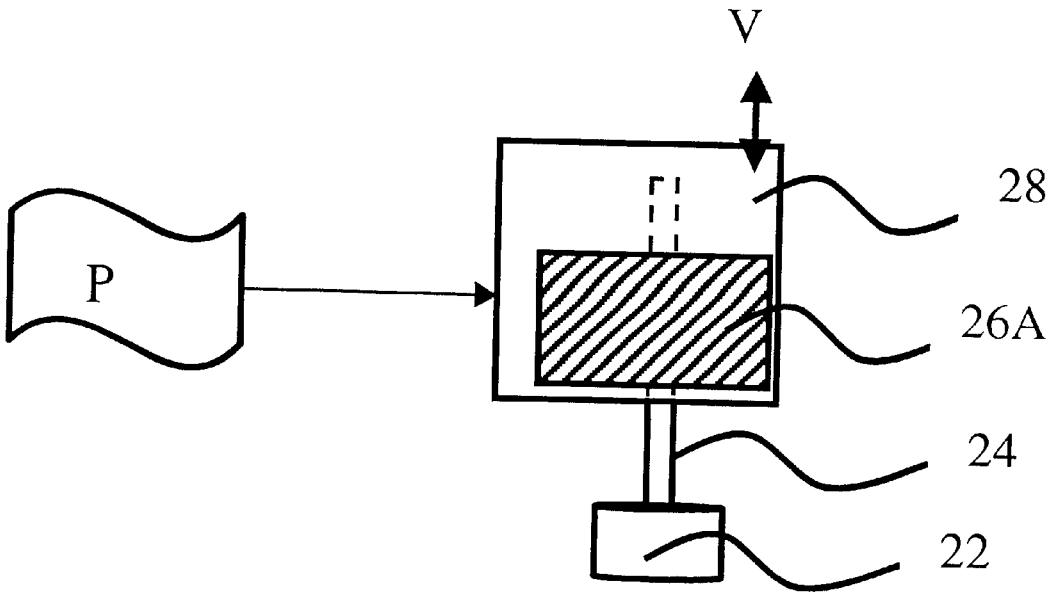
FIG. 2A shows the design of the collator based on the present invention.
Figure 2B:
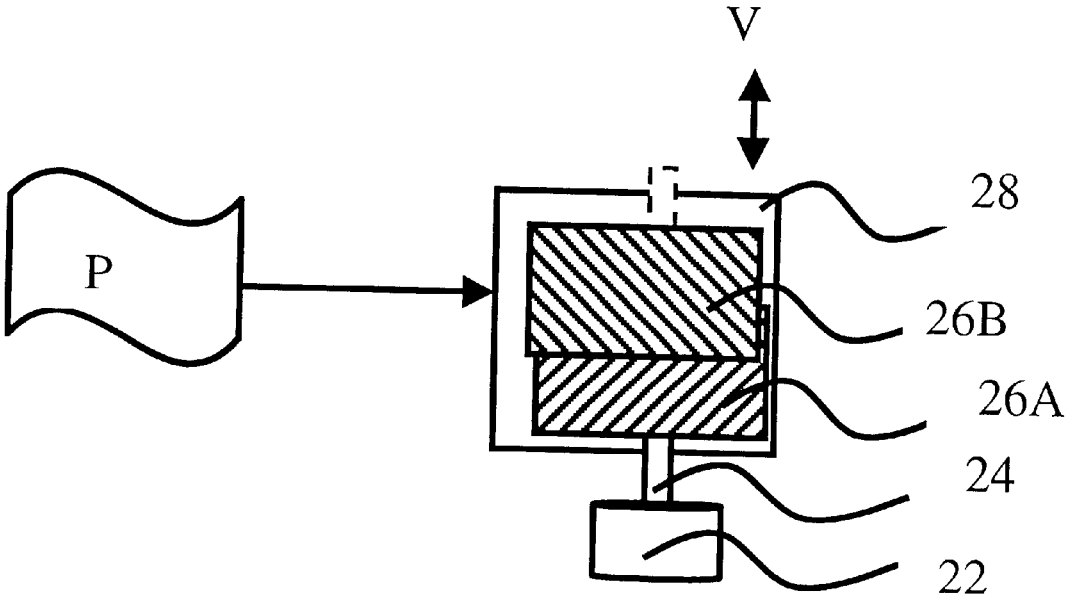
FIG. 2B allows the basic operation of the collator based on the present invention.
Figure 2C:
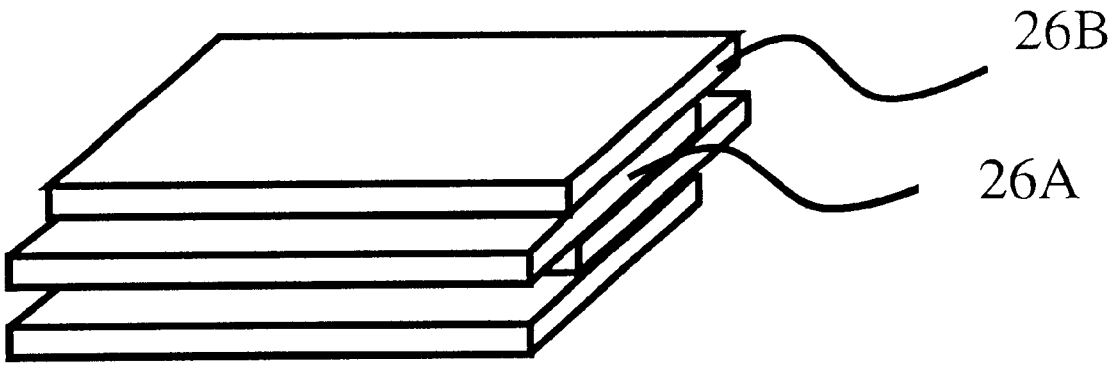
FIG. 2C shows the resulting stacking of the pages of the present invention.

FIG. 2A and FIG. 2B show the first embodiment of the present invention. There is only one tray 28, which is capable of moving back and forth in the V direction. A motor 22 pushes the push rod 24 according to instructions from the CPU and causes the tray 28 to move back and forth in the V direction. In FIG. 2A, the tray is in a first position and stacks the documents as stack 26A. In FIG. 2B, the tray 28 is in a second position and stacks the second group of documents as stack 26B. Stack 26A and stack 26B are staggered as shown in FIG. 2C, and are thus separated and collated.

Figure 3A:
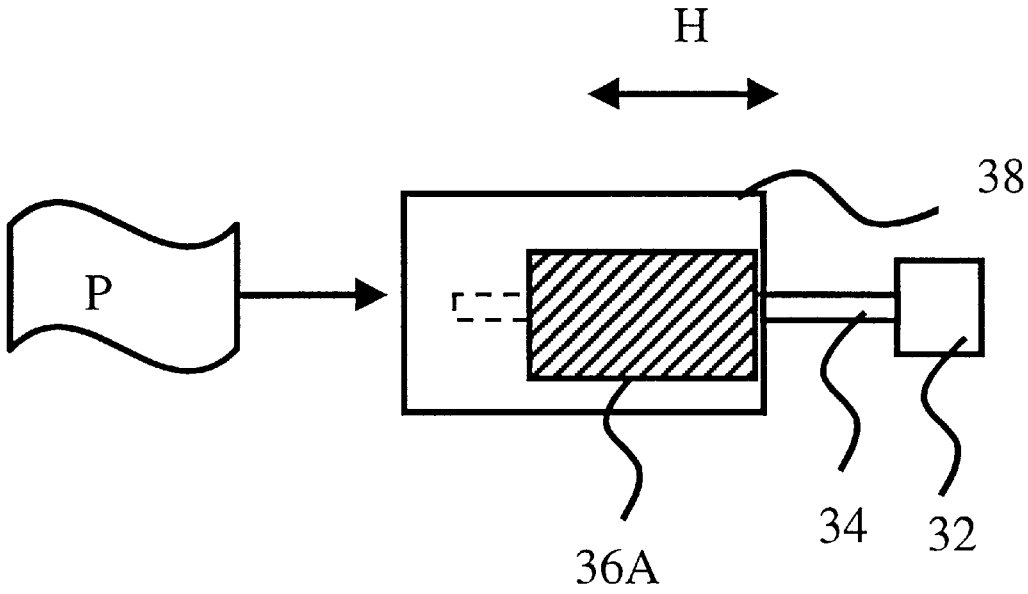
FIG. 3A shows a second embodiment of a collator of the present invention.
Figure 3B:
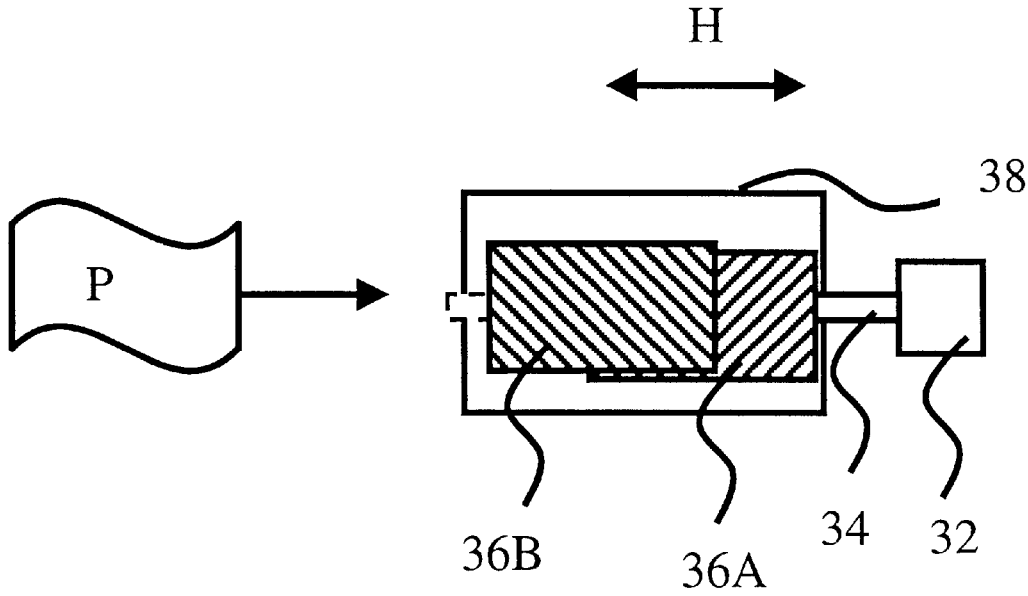
FIG. 3B shows the operation of the second embodiment.
Figure 3C:
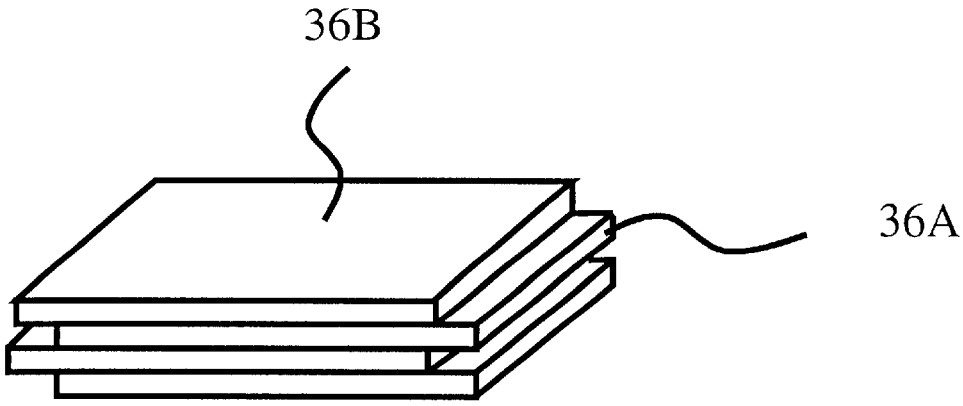
FIG. 3C shows the resulting stacking of the papers of the second embodiment.

FIG. 3A and FIG. 3B shows a second embodiment of the present invention. Again, there is only one tray 38, which can be pushed to move back and forth in the H direction. The motor 32 drives the guiding rod 34 to effect the reciprocating motion, according to control signals received from a CPU. FIG. 3A shows the tray 38 in a first position to collect the first group of papers P to form stack 36A. FIG. 3B shows the tray 38 in a second position to collect the second group of papers to form stack 36B. The documents in stack 36A and stack 36B are staggered as shown in FIG. 3C. Thus the collating function is accomplished.

Figure 3D:
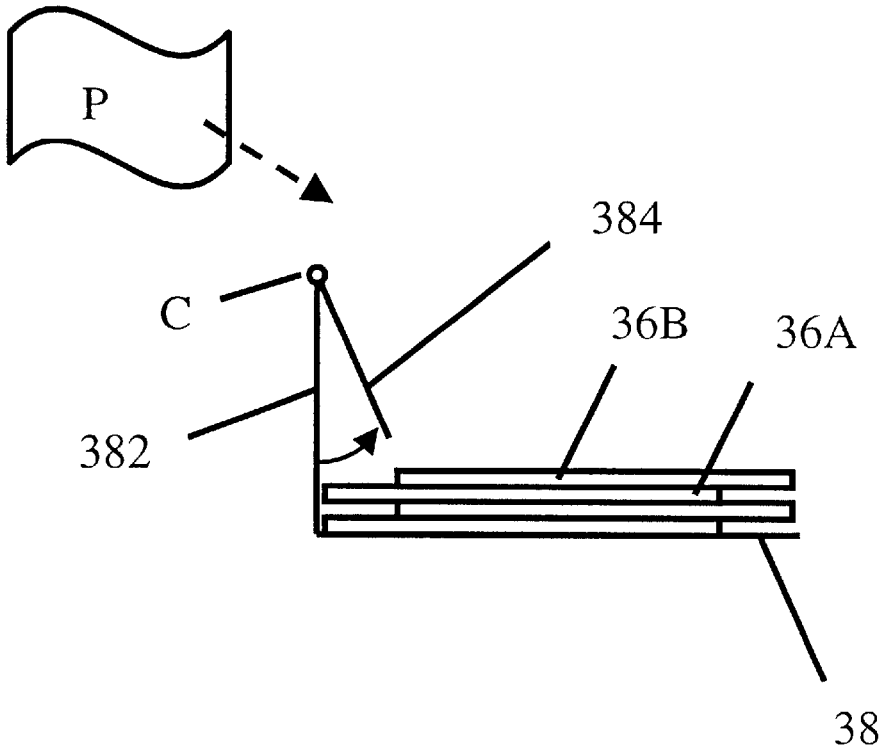
FIG. 3D shows a third embodiment of the present invention.

FIG. 3D shows a third embodiment of the present invention, which accomplishes the same result as FIG. 3C. The collating tray 38 has a side wall 382. At the top of the side wall is an axle C, to which a guide plate 384 is attached. The guide plate 384 can swing back and forth according to the control signal from a CPU. When the guide plate is in a first position and the angle between the guide plate 384 and the vertical wall 382 is zero, the papers dispatched from the source P are stacked up as document 36A. When the guide plate 384 forms an angle, say 30 degrees, with the vertical wall 382, the papers dispatched from the source P are stacked up as document 36B. The documents 36A and 36B are staggered as shown in FIG. 3C, which is the result of the separating operation shown in FIG. 3D.

Figure 3E:
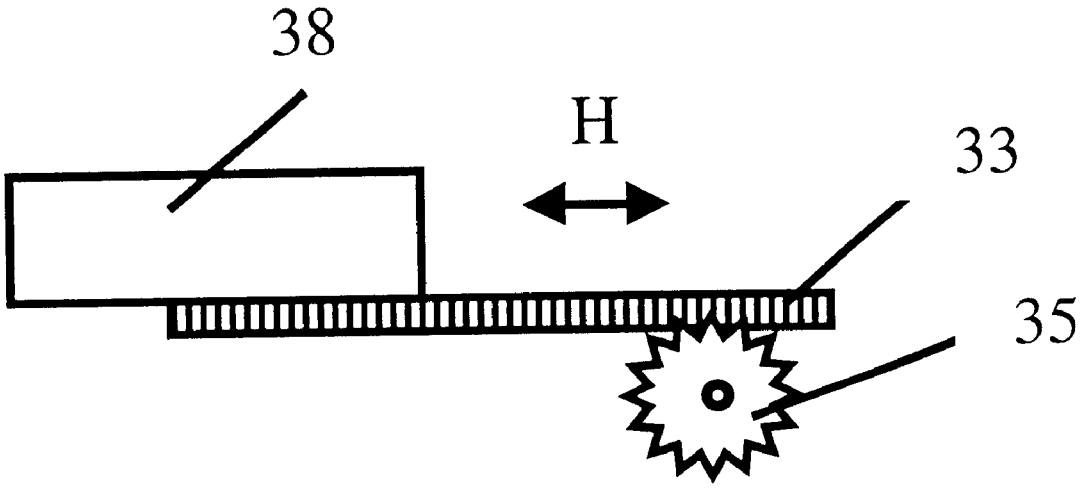
FIG. 3E shows a fourth embodiment of the collator of this invention.

FIG. 3E shows a fourth embodiment of the present invention which also can yields a result similar to that in FIG. 3C. The reciprocating motion is produced by a rack and pinion motion. A rack 33 is attached to the tray 38 and a pinion 35 driven by a motor engages the rack 33 to produce the reciprocating motion along the H direction. The papers collected by the tray are sorted into two stacks as shown in FIG. 3C.

Figure 4A:
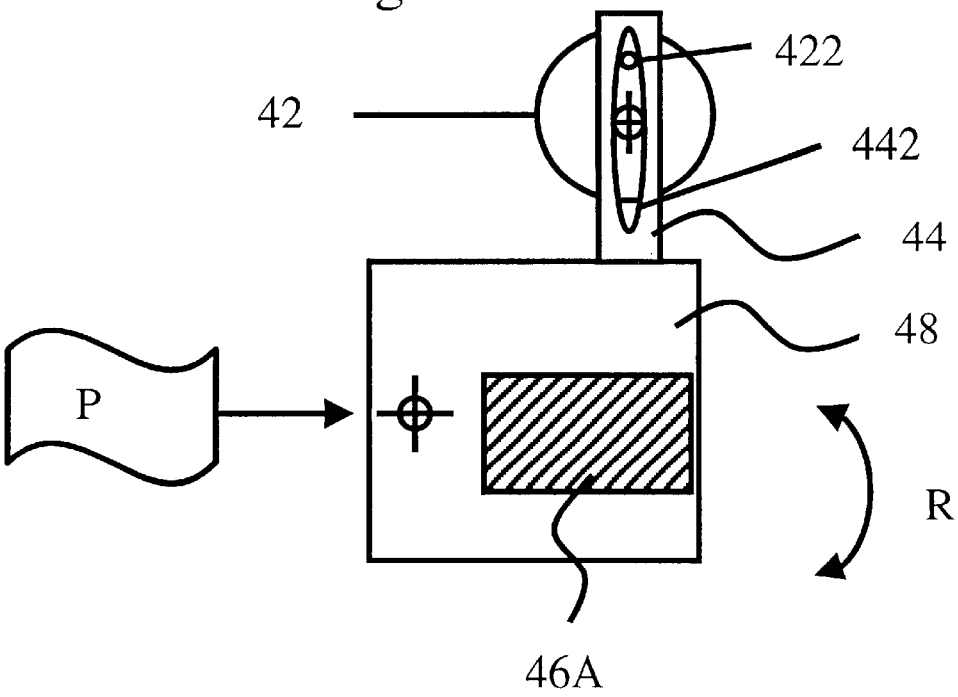
FIG. 4A shows a fifth embodiment of the collator of the present invention.
Figure 4B:
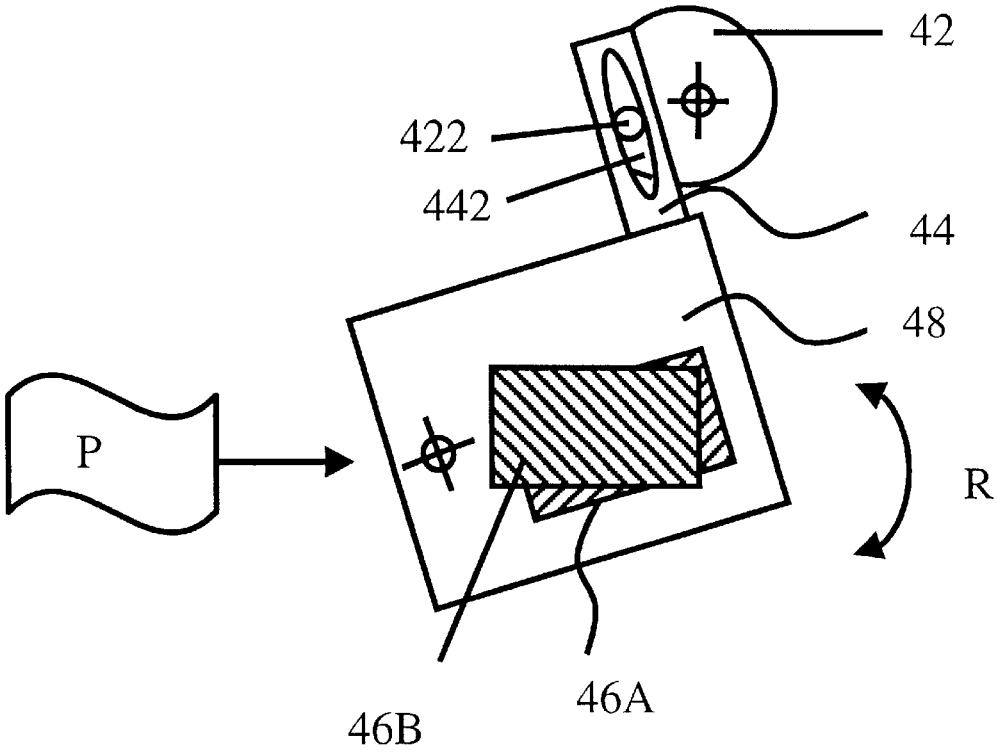
FIG. 4B shows the operation of the fifth embodiment.

FIG. 4A shows a fifth embodiment of the present invention. The tray 48 is pivoted at one end and is equipped with a slotted handle 44 with a slot 442. A driving wheel 42 has a pin 422 protruded from the edge of the wheel surface through the slot 442. When the wheel rotates, the pin 422 slides back and forth along the slot 442, causing the tray to rotate back and forth with respect to the axis the pivot. The motor driven wheel rotates according to the control signal from the CPU. FIG. 4A shows the tray 48 in a first position to collect the papers from source P as stack 46A. FIG. 4B shows the tray 48 in a second position to collect papers from source P as stack 46B. Thus the documents are separated and collated. The wheel 42 can also be replaced with an eccentric wheel or a protruded wheel.

Figure 4C:
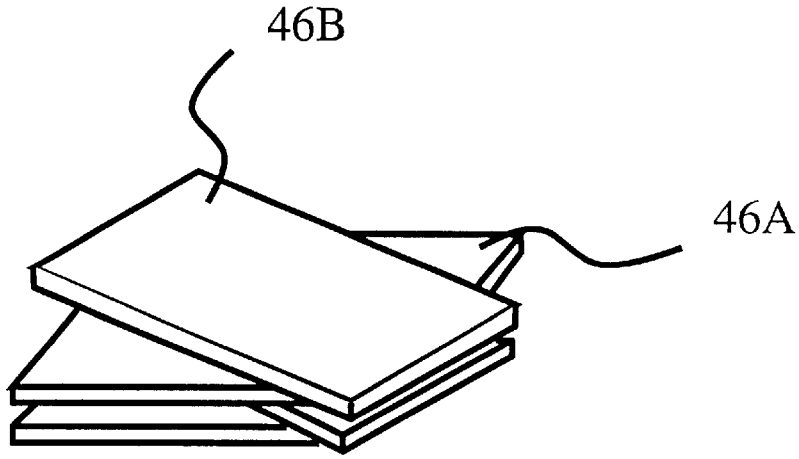
FIG. 4C shows the resulting stacking of the pages of the fifth embodiment.
Figure 4D:
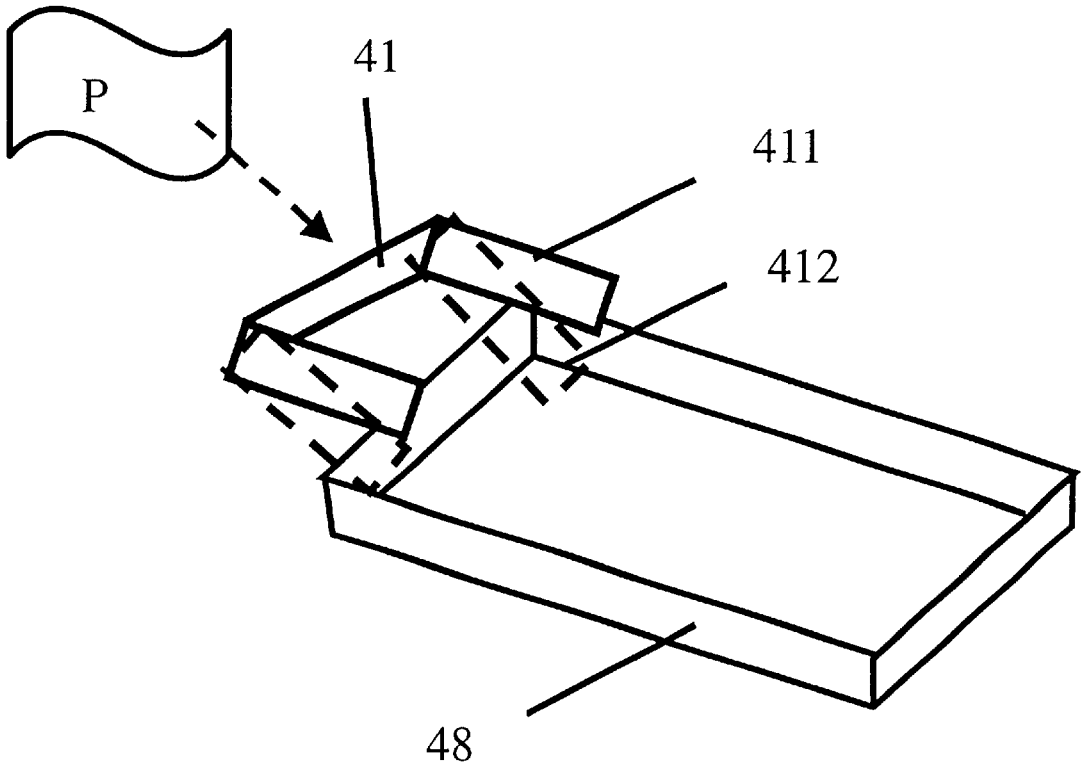
FIG. 4D shows a mechanism to effect the fifth embodiment.

FIG. 4D shows a sixth embodiment of the present invention. At the exit port of the paper source P is placed a guide 41, which has two side walls. The side walls can be tilted at different angles. In one position of tilt, the side walls 411 are as shown in solid line and guide the papers as stack 46A. In a second position of tilt, the side walls 412 are as shown in dotted line and guide the papers as stack 46B. Thus the two stacks are sorted as shown in FIG. 4C.

Figure 4E:
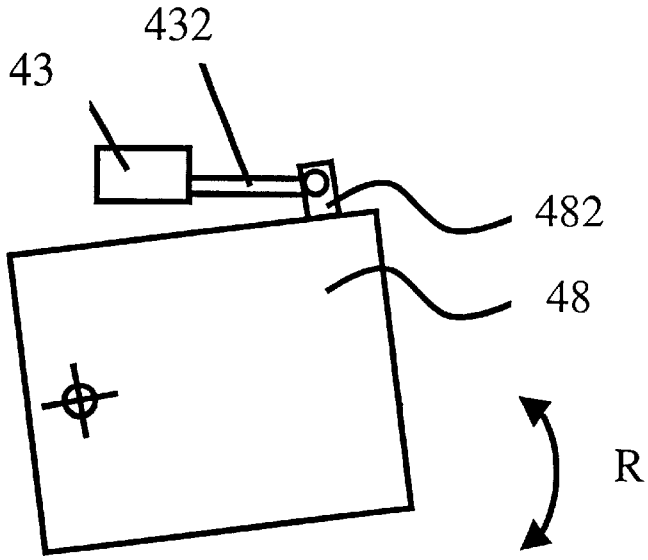
FIG. 4E shows another mechanism to effect the fifth embodiment.

FIG. 4E shows a seventh embodiment of the present invention. Here the tray 48 is pivoted at one end and attached to an arm 432 through a coupling 482. The arm is actuated by turning on and off an electromagnet 43. The force on the electromagnet causes the tray to rotate back and forth along an arc R. The tray 48 collects the documents and separates them as shown in FIG.4C.

Figure 4F:
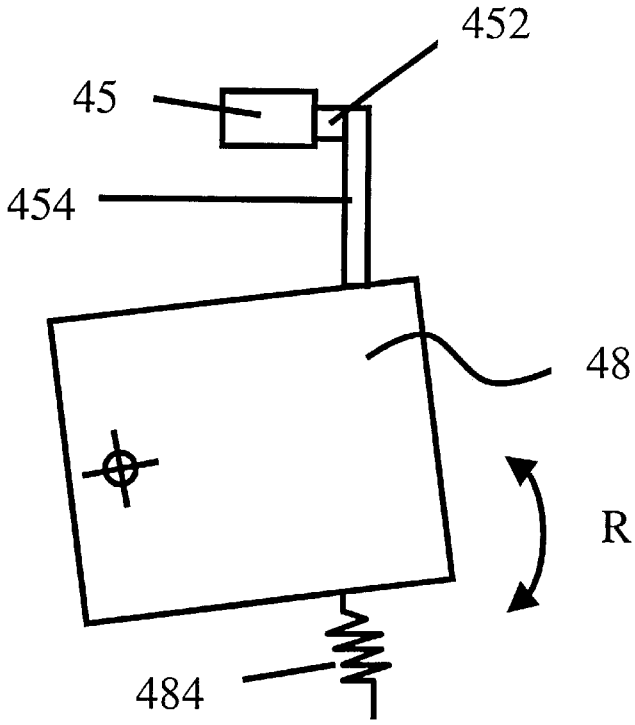
FIG. 4F shows still another mechanism to effect the fifth embodiment.

FIG. 4F shows an eighth embodiment of the present invention. A pivoted paper receiving tray 48 is attached to a belt 454, which is coupled to a driving motor through an eccentric idler 452. The eccentricity of the idler 452 causes the tray 48 to move along the arc R. The other side of the tray opposite the belt 454 is pushed by a spring 484. With this arrangement, the tray 48 can move back and forth. Papers are received by the tray during stationary positions. In this manner, the papers are collated as shown in FIG. 4C.

Figure 5:
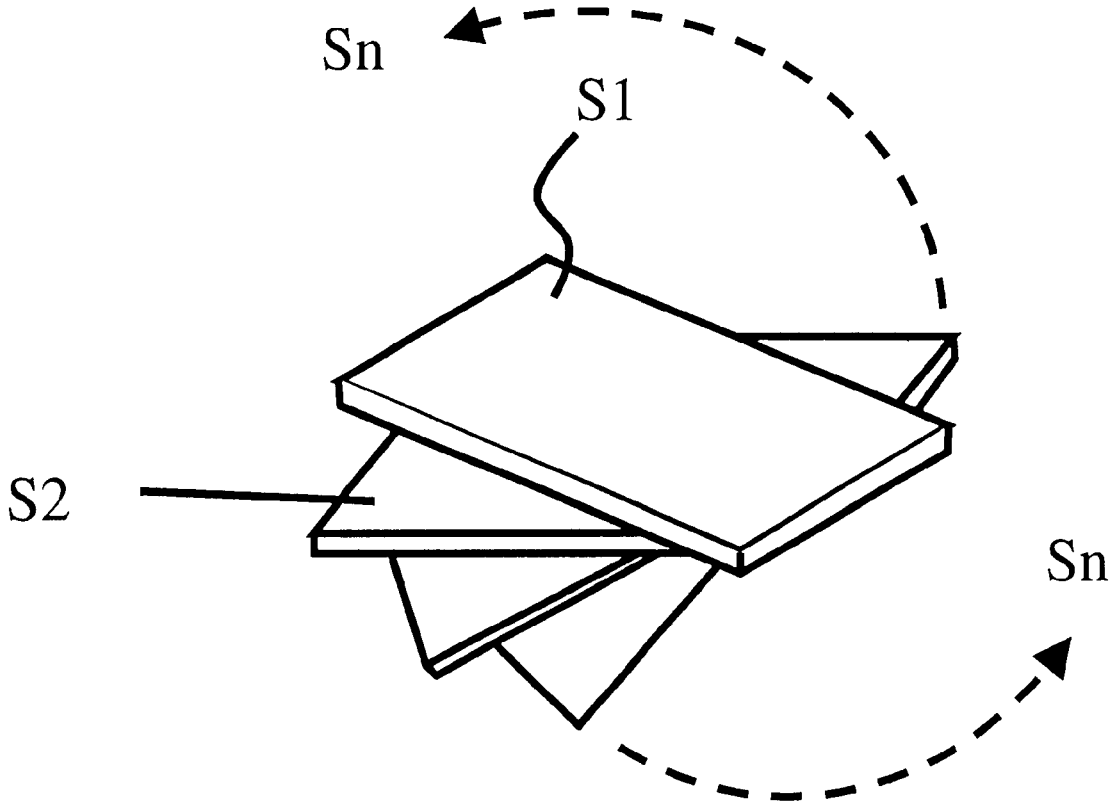
FIG. 5 shows N stacks after collation by means of the fifth embodiment.

FIG. 5 shows a ninth embodiment of the present invention to collate the papers into N number of stacks. In this scheme, the collecting tray is rotated N times in one cycle. For instance, if the tray is moved 30 degrees in every move, the collected papers are collated into 360/30=12 stacks. Any of the schemes shown in FIGS. 4A, 4B, 4D, 4E and 4F with circular distribution can be used to effect this multiple stack collator.

While the preferred embodiments of this invention have been shown and described, it will be apparent to those skilled in this art that various modifications may be made in the embodiments without departing from the spirit of the present invention. Such modifications are all within the scope of this invention.

What is claimed is:

1. A collator for a printer, the collator comprising:

a tray pivotally installed, at one end thereof, in the printer for collecting papers exiting from the printer;

a rigid handle directly fixed on the tray at another end of the tray, the handle having a slot; and a driving wheel having a pin fixed at a rim of the driving wheel;

wherein the pin is positioned inside the slot of the handle and when the driving wheel is rotated, the pin moves along the inner side of the slot to pivotally move the handle and the tray back and forth in a curvilinear motion.

2. The collator of claim 1 wherein the slot has an oval shape.

3. A collator for a printer, the collator comprising:

a tray pivotally installed, at one end thereof, in the printer for collecting papers exiting from the printer and collating the papers in at least two positions, the positions being separated from one another by an angular displacement;

a rigid handle directly fixed on the tray at another end of the tray, the handle having a slot; and driving wheel having a pin fixed at a rim of the driving wheel;

wherein the pin is positioned inside the slot of the handle and when the driving wheel is rotated, the pin moves along the inner side of the slot to pivotally move the handle and the tray back and forth in a curvilinear motion.

* * * * *